United States Patent [19]

Lew

[11] 3,937,461

[45] Feb. 10, 1976

[54] EXERCISER FOR AERIAL CALISTHENICS

[76] Inventor: Hyok Sang Lew, 17776 W. 14th Ave., No. 2, Golden, Colo. 80401

[22] Filed: Dec. 26, 1973

[21] Appl. No.: 427,804

[52] U.S. Cl. ..... 272/60 R; 272/80; 294/78 R; 294/81 R; 182/6

[51] Int. Cl.[2] ..... A63B 7/02

[58] Field of Search ..... 272/57 R, 60, 80, 61; 128/25 R, 75; 294/78 R, 81 R; 254/188, 189

[56] References Cited

UNITED STATES PATENTS

| | | | |
|---|---|---|---|
| 1,675,552 | 7/1928 | Hawxhurst | 272/80 |
| 2,842,819 | 7/1958 | Granath | 294/81 R |
| 3,432,163 | 3/1969 | Murphy | 272/60 |

FOREIGN PATENTS OR APPLICATIONS

| | | | |
|---|---|---|---|
| 279,927 | 1952 | France | 272/80 |
| 1,321,733 | 1963 | France | 272/80 |
| 829,380 | 1938 | France | 272/60 |

*Primary Examiner*—Richard C. Pinkham
*Assistant Examiner*—Joseph R. Taylor

[57] ABSTRACT

An arrangement of a harness, hoist and handles for the variable tension ring exerciser is disclosed. The harness includes a pair of small rings secured to two diametrical sides of a belt securable around the lower portion of the torso of a person and a pair of Y-shaped straps securable around thighs of the person wearing the harness. The end of the first branch of the first Y-shaped strap is secured to the belt of the harness at a proximity to the first small ring, to which end means of securing the stem of the first Y-shaped strap is attached. The end of the second branch of the first Y-shaped strap is secured to the belt intermediate the first small ring and the middle point of the rear half of the belt. The second Y-shaped strap including means of securing its stem is similarly secured to the belt in the vicinity to the second small ring. The hoist includes a pair of elongated structural members having cross section of a channel, within the grooves of which channels a plurality of sheaves are rotatably secured in a series aligned along the length of each elongated structural member. This pair of elongated structural members are linked to one another by a pair of ropes repeatedly engaging various pairs of sheaves, each of which pairs of sheaves includes the first sheave belonging to one elongated structural member and the second sheave belonging to the other elongated structural member. The longer of two elongated structural members includes a pair of pulleys suspended from two ends of that member, respectively. The handle is formed by three segments of tubular rods threaded in series by a rope, which rope is tied to form a closed loop resulting a triangular ring with three sides formed by three segment of tubular rods.

6 Claims, 12 Drawing Figures

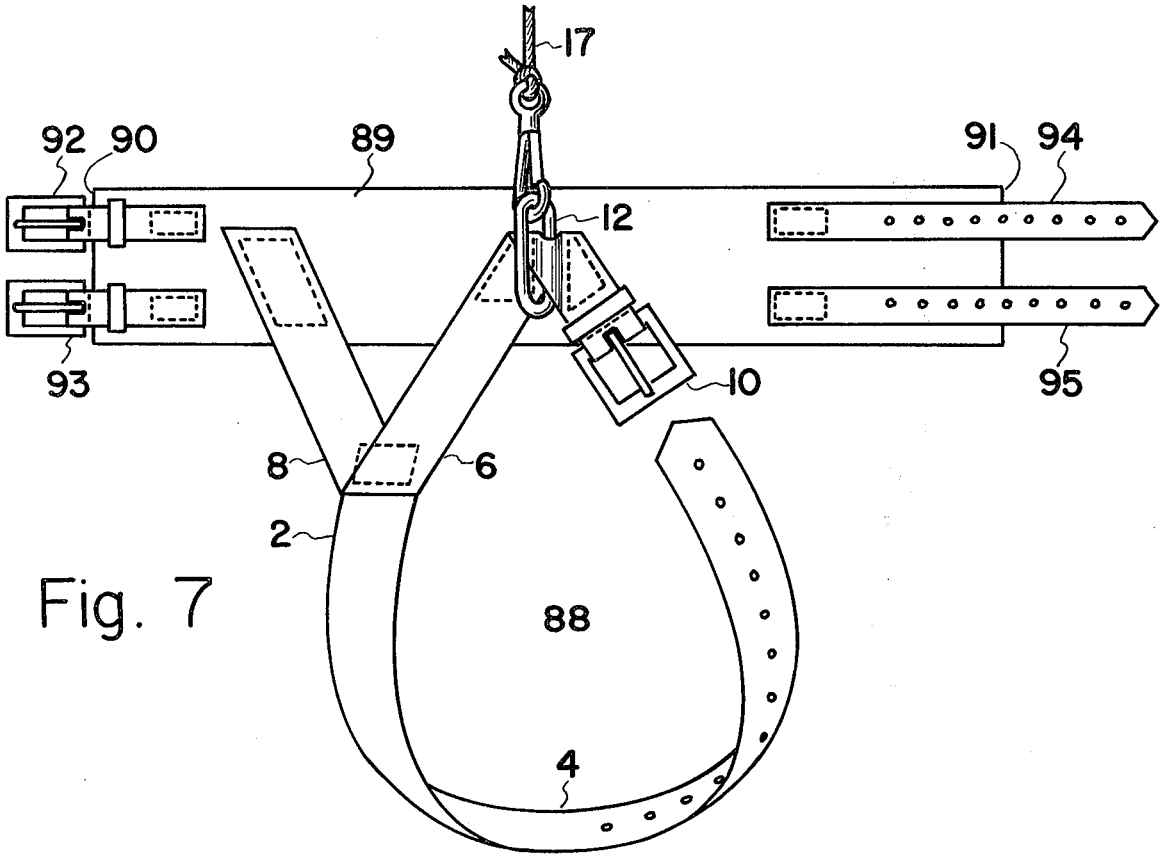
Fig. 7
Fig. 8
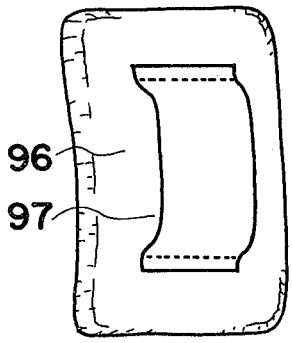
Fig. 9
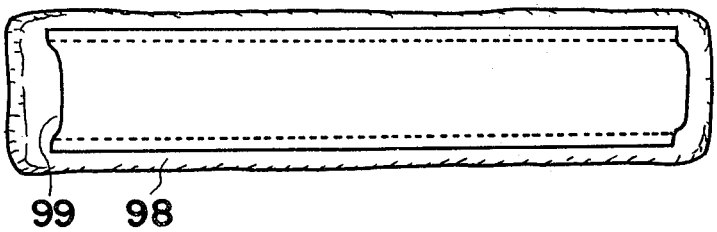
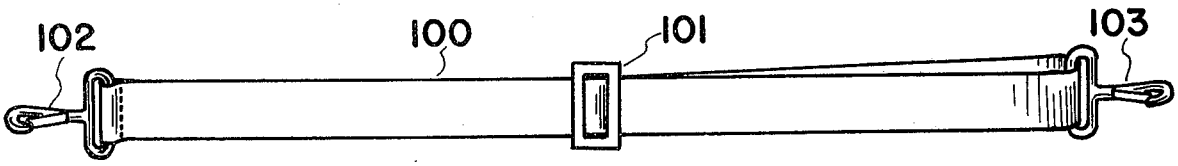
Fig. 10

EXERCISER FOR AERIAL CALISTHENICS

The present invention relates to a harness, hoist and handles for pulling a person up in midair himself, and more particularly, to a harness, hoist and handles used in constructing a variable tension ring exerciser invented by this inventor.

The variable tension ring exerciser is an exercising apparatus including a pair of ring-shaped handles, a hoist suspended in mid air and a harness securable around the lower torso of the exercising person. The pair of handles are secured to the ends of two ropes suspended from the hoist, respectively, each of which ropes engages each of a pair of pulleys included in the hoist. The harness is connected to the hoist by means of a pair of ropes extending from two diametrical sides of the belt included in the harness. With this arrangement, a pulling force exerted on both handles by the exercising person lifts him off the ground and suspends in midair, which enables him to perform a variety of airborne exercises. The tensions exerted on the pair of ropes connected to the handles created by the body weight of the exercising person can be varied by changing the combination of the sheaves engaged by those ropes, which sheaves are included in the hoist. It may be understood that the variable tension ring exerciser can be also used for exercising without making the exercising person airborne.

The variable tension ring exerciser is one of a few exerciser, which enables noneathletes to perform aerial exercises. It provides fun and exercise for those untalented and unskilled as well as for those experienced in physical exercises. As an exercising apparatus for average people, the variable tension ring exerciser must be easy and comfortable to use. The harness used in the variable tension ring exerciser must provide a confortable support for lifting the exercising person. The hoist used in the variable tension ring exerciser must operate smoothly under all possible loading conditions arising from the various phases of exercising. The handles used in the variable tension ring exerciser must provide a sure and comfortable grip. Yet all of these elements of the variable tension ring exerciser can be manufactured easily and inexpensively, which is an essential condition to make the variable tension ring exerciser available to average people.

It is therefore a primary object of the present invention to provide a harness for the variable tension ring exerciser, which harness is comfortable to wear.

Another object of the present invention is to provide a harness for the variable tension ring exerciser, which harness permits the maximum freedom for the body movements.

Still another object of the present invention is to provide a harness for the variable tension ring exerciser, which harness includes a pair of Y-shaped straps securable around the thighs.

Yet another object of the present invention is to provide a harness for the variable tension ring exerciser, which harness is easy and inexpensive to manufacture.

A further object of the present invention is to provide a light weight hoist for the variable tension ring exerciser, which hoist operates smoothly under all possible loading conditions arising from various phases of exercising.

Still further object of the present invention is to provide reliable and inexpensive hoist for the variable tension ring exerciser.

Yet further object of the present invention is to provide a handle for the variable tension ring exerciser, which handle is inexpensive to manufacture and yet provides a comfortable and sure grip.

These and other objects of the present invention will become apparent to those skilled in the art as the description thereof proceeds.

The present invention may be described with greater specificity and clarity with reference to the following drawings, in which:

FIG. 7 illustrates the isometric view of the right-half of the harness.

FIG. 8 illustrates a perspective view of a pad attachable to the belt included in the harness.

FIG. 9 illustrates a perspective view of a pad attachable to the thigh strap included in the harness.

FIG. 10 illustrates an isometric view of a shoulder strap usable in conjunction with the harness.

Figure 1:
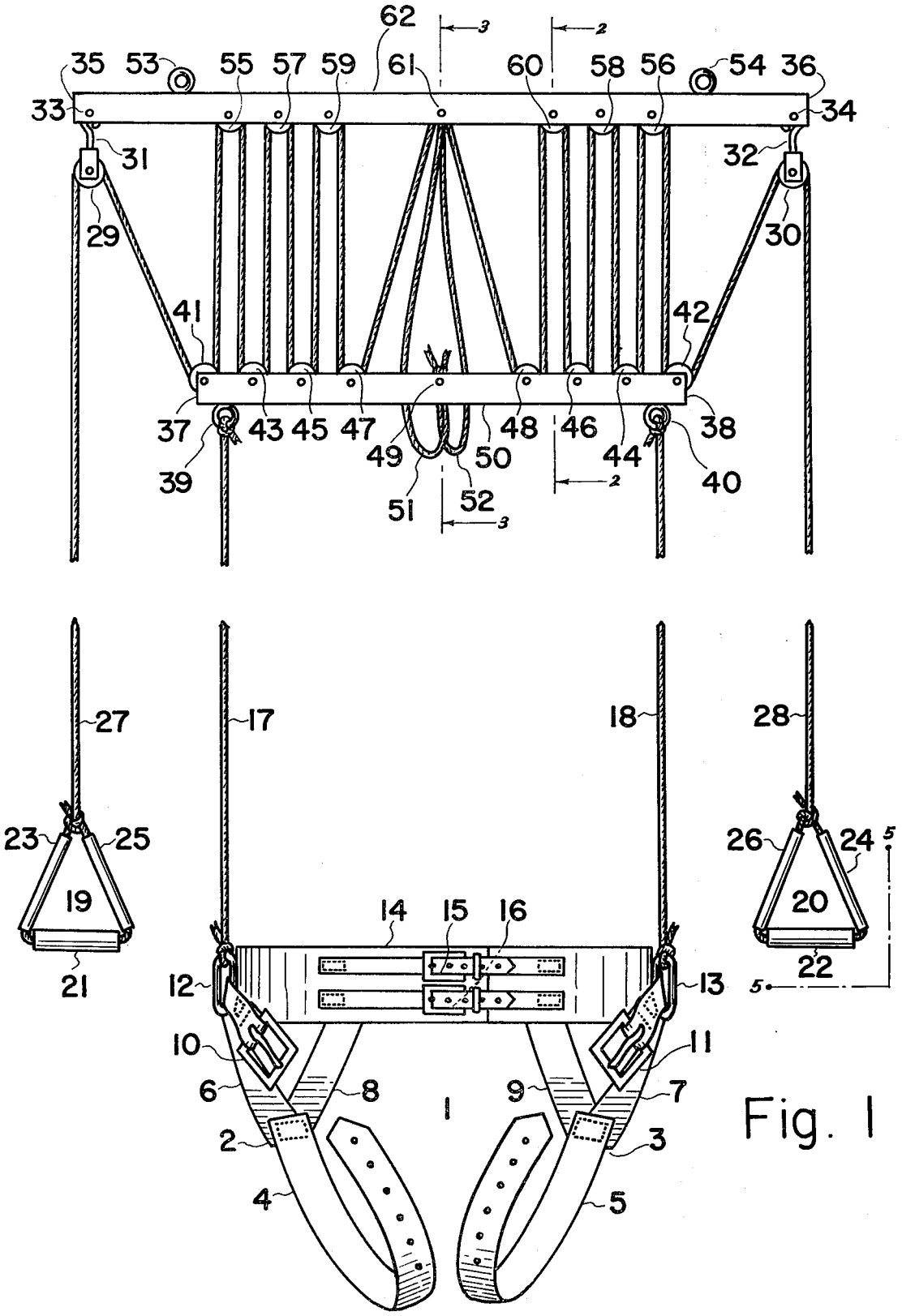
FIG. 1 illustrates an isometric view of the variable tension ring exerciser employing the harness, hoist and handles of the present invention.

Referring to FIG. 1, there is shown the variable tension ring exerciser invented by this inventor, in which exerciser the harness, hoist and handles of the present invention are incorporated. The harness 1 securable around the lower torso of the exercising person is suspended from a elongated structural member 50 by means of a pair of ropes 17 and 18. The lower end of rope 17 is secured to a ring 12 attached to one side of belt 14 included in harness 1 while its upper end is secured to an eye bolt 39 affixedly secured to elongated member 50 near one extremity 37. The lower end of rope 18 is secured to a ring 13 attached to the other side of belt 14 while its upper end is secured to an eye bolt 40 affixedly secured to elongated structural member 50 near other extremity 38. The handles 19 and 20 are attached to the lower ends of ropes 27 and 28, respectively. The rope 27 is suspended from pulley 29 as that rope engages that pulley. The rope 28 engages pulley 30 and is suspended therefrom. The pulleys 29 and 30 are pivotably secured to an elongated structural member 62 near its two extremities 35 and 36, respectively. The elongated structural member 62 is securable horizontally to an over handing structure such as a beam, a branch of tree, etc., by means of ropes, wires or bolts engaging eye bolts 53 and 54 affixedly attached to elongated member 62 near two extremities 35 and 36, respectively. The elongated structural members 50 and 62 are linked to one another by ropes 27 and 28 engaging a plurality of sheaves disposed along two elongated structural members. With this arrangement of harness 1, handles 19 and 20 and hoist composed of elongated structural members 50 and 62 including a plurality of sheaves, it may be understood that the exercising person can lift himself off ground by pulling both handles with a force equal to a fraction of his body weight. The tensions on ropes 27 and 28 can be adjusted from a fraction of the body weight to the equal of body weight by varying the combinations of sheaves engaged by ropes 27 and 28.

Figure 2:
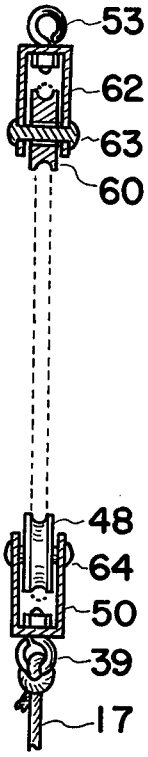
FIG. 2 illustrates the cross section of the hoist taken along line 2—2, as shown in FIG. 1.
Figure 3:
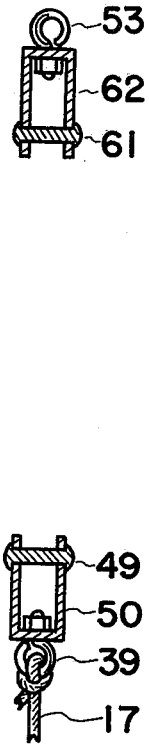
FIG. 3 illustrates the cross section of the hoist taken along line 3—3, as shown in FIG. 1.

One of the most efficient and economic way of constructing the hoist included in the variable tension ring exerciser is to use a pair of elongated structural member 50 and 62 having cross section of a channel. In FIG. 2 there is shown the cross section of elongated structural members 50 and 62 taken along line 2-2, as shown in FIG. 1. The plurality of sheaves 41, 42, 43, 44, 45, 46, 47, 48, disposed within the groove of elongated structural member 50, and sheaves 55, 56, 57, 58, 59, 60 disposed within the groove of elongated member 62 are rotatably secured to each elongated structural members, as each of the holes disposed at the center of those pulleys is engaged by a cylindrical rod such as a bolt or rivet laid across the channel and secured to both walls of the channel at both extremities of that rod. Such arrangement of mounting sheaves is shown in FIG. 2 where the cross sections of sheave and rod 63 engaging the hole disposed at the center of sheave 60 is illustrated. Referring to FIG. 1, the spare length 51 of rope 27 and 52 of rope 28 left after engaging plurality of sheaves are first tied to a rod 61 secured across the channel of elongated structural member 62 at the middle point thereof and then tied to rod 49 similarly secured to elongated structural member 50. The arrangement of rods 49 and 61 secured to elongated members 50 and 62, respectively, is illustrated in FIG. 3, which figures shows the cross section of two elongated structural members taken along line 3—3, as shown in FIG. 1. With spare lengths of ropes 51 and 52 simultaneously tied to the middle points of elongated members 50 and 62 as shown in FIG. 1, it may be understood that the exercising person is restrained from falling all the way down to the ground even when he releases both handles 19 and 20 accidentally. The length of elongated member 62 is made longer than that of elongated member 50 to prevent extremities 37 and 38 of elongated member 50 from interfering with the motion of ropes 27 and 28.

Figure 4:
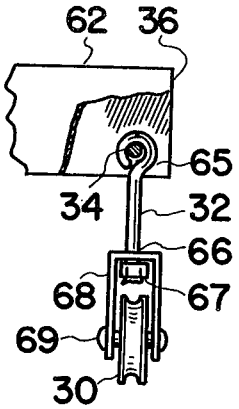
FIG. 4 illustrates a cut out view showing the pivotably mounted pulleys included in the hoist.

For a facile and smooth operation of the variable tension ring exerciser shown in FIG. 1, it is necessary to suspend pulleys 29 and 30 from two extremities 35 and 36 of elongated structural member 62, respectively, in such a way that pulleys 29 and 30 are pivotable about the points of attachments 33 and 34, respectively, over a sizable solid angle and that pulleys 29 and 30 are rotatable about eye bolts 31 and 32, respectively, which eye bolts secures those pulleys to elongated structural member 62. The arrangement of suspending pulleys 29 and 30 from two extremities 33 and 34 of elongated structural member 62, respectively, is further illustrated by a cut out view shown in FIG. 4. The pulley assembly including sheave 30 is constructed of a narrow segment of channel 68 and a sheave 30 rotatably secured within the groove of the segment of channel 68 by means of a rod 69 engaging the hole disposed at the center of sheave 30. The lower end of eye bolt 32 rotatably engages a hole 66 disposed on the base of segment of channel 68. A nut 67 engaging the lower end of eye bolt 32, which nut is welded or jamed to that eye bolt, restrains eye bolt 32 from disengaging from hole 66. The eye 65 of eye bolt 32 is engaged by a rod 34 secured across the channel of elongated structural member 62 near its extremity 36, which rod 34 has diameter sizably smaller than the diameter of eye 65 of eye bolt 32. With this arrangement, it may be understood that pulley assembly including sheave 30 is permitted to rotate relative to eye bolt 32 about the axis of that eye bolt and to pivot about rod 34 over a sizable solid angle. The pulley assembly including sheave 29 are similarly constructed and similarly secured to elongated structural member 62 near extremity 35.

Figure 5:
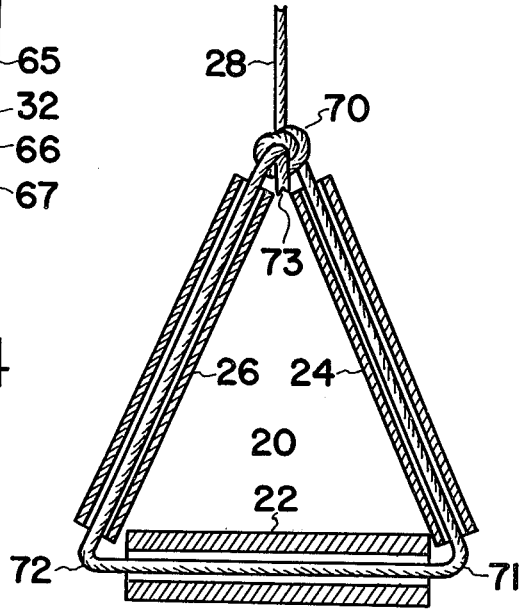
FIG. 5 illustrates the cross section of the handle taken along plane 5—5, as shown in FIG. 1.

In FIG. 5, there is illustrated the cross section of handle 20 taken along plane 5—5, as shown in FIG. 1. A tubular rod 22 is sandwiched between a pair of segment of tubes 24 and 26 as they are threaded in series by rope 28. The end 73 of rope 28 is tied to that rope to form a triangular ring with three sides formed by tubular rods 22, 24 and 26. The length and diameter of tubular rod 22 have to be sufficiently large to provide a comfortable hand grip. The length of tube 24 and 26 have to be sufficiently long to provide a cavity within the ring large enough for the movement of hand through that cavity. The pair of tubes 24 and 26 restrain the hand grip 22 from sliding along the looped portion of rope 28 and thus aids to provide a firm hand grip. The handle 19 is similarly constructed.

Figure 6:
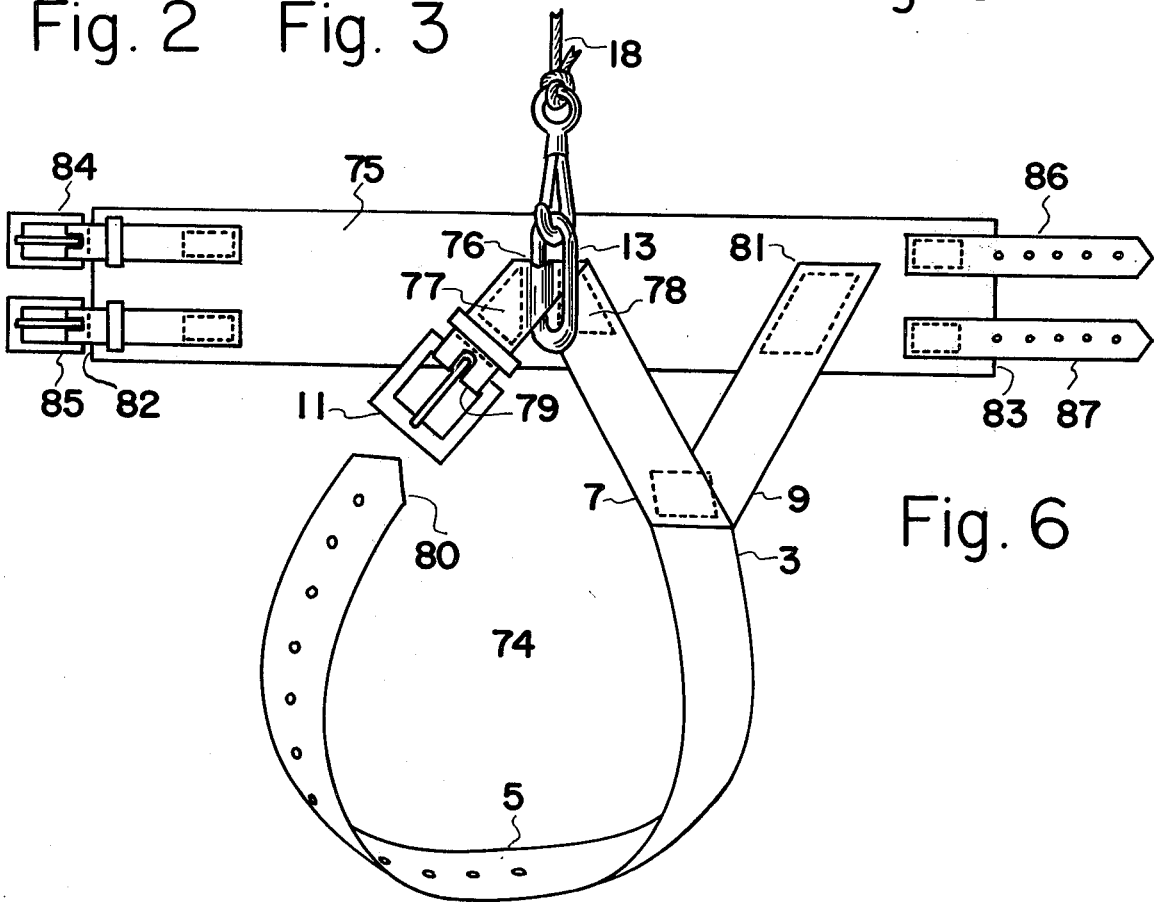
FIG. 6 illustrates the isometric view of the left-half of the harness.

The harness 1 shown in FIG. 1 can be disassembled into left half 74 illustrated in FIG. 6 and right half 88 illustrated in FIG. 7. The left half 74 of harness 1 includes a segment of belt 75, a ring 13 secured to bolt 75 at the middle point thereof by means of the first branch 7 of Y-shaped strap 3, which branch of that strap is threaded through ring 13 and secured to belt 75 at both sides of ring 13 by means such as stitches 77 and 78. The branch 7 of Y-shaped strap 3 is folded into the inverted V-shape as that branch of that strap is threaded through ring 13. The end of Y-shaped strap 3 can be secured to the end of branch 7 of that strap by means of buckle 11 attached to end 79 of that branch of the strap. A fastener such as the pull-and-tighten type used in the parachute harness may be used instead of buckle 11. The end of second branch 9 of Y-shaped strap 3 is secured to belt 75 intermediate ring 13 and the rear end 83 of that belt. A pair of fastening means such as buckles 84 and 85 attached to the front end 82 of belt 75 respectively receive and secure the pair of straps 94 and 95 attached to the front end 91 of belt 89 included in the right half 88 of harness 1, which half is illustrated in FIG. 7. A pair of fastening means such as buckles 92 and 93 attached to the rear end 90 of belt 89 respectively receive and secure the pair of straps 86 and 87 attached to the rear end 83 of belt 75. The right half 88 of harness 1 includes belt 89, ring 12 and Y-shaped strap 2 having a pair of branches 8 and 6, stem 4 and buckle 10, which elements are assembled in a manner similar to those elements included in left half 74 of the harness. With these arrangements of both halves of the harness, the configuration of the assembled harness shown in FIG. 1 is symmetric with respect to a hypothetical plane bisecting the harness into the right and left halves.

Referring to FIG. 1 again, the means 15 including buckles 84 and 85 and straps 94 and 95 (see FIGS. 6 and 7) for adjusting and securing the length of the front half of belt 14 and the means 16 including buckles 92 and 93 and straps 86 and 87 (see FIGS. 6 and 7) for adjusting the length of the rear half of belt 14 enables the exercising person to secure harness 1 around his lower torso in such a way that rings 12 and 13 become located precisely at two diametrical sides of the lower torso. The pair of Y-shaped straps 2 and 3 aid in securing harness 1 firmly to the lower torso of the exercising person and yet permit maximum freedom for the body movements as branches 8 and 9 of the Y-shaped straps help to keep the Y-shaped straps secured around the thighs at their very roots. When a person does exercise in the upright position, the Y-shaped straps 2 and 3 provide the major support in sustaining his weight. When a person does exercise in the prone or supine position, belt 14 provides the major support in sustaining the body weight of the exercising person. The Y-shaped straps 2 and 3 provide a particularly comfortable support as those straps form a basket-life support for the hip of the exercising person.

Individuals with soft skins needs extra paddings for the harness to protect the hip bones from the belt included in the harness as well as to protect the fleshes on the thighs from the thigh strap of the harness. In FIG. 8, there is shown a pad 96 attachable to the belt of the harness near rings 12 or 13 by threading belt 75 of the left half of the harness or by threading belt 89 of the right half of the harness through slit 97. There is shown in FIG. 9 a pad 98 attachable to stem 4 or stem 5 of the Y-shaped thigh straps by threading stem 4 or stem 5 through slit 99 disposed along pad 98. The synthetic sponges and fluffy fabrics such as blanket materials are excellent for padding. In FIG. 10, there is shown a shoulder belt 100 usable in conjunction with harness 1 shown in FIG. 1. The length of shoulder belt 100 can be adjusted and secured by means of buckle 101. A pair of snaps 102 and 103 attached to two ends of shoulder belt 100, respectively, are made to engage rings 12 and 13 attached to the belt of the harness, respectively. A pair of snaps secured to the lower ends of ropes 17 and 18 may be used to connect those ropes to rings 12 and 13 attached to the belt included in the harness, as illustrated in FIGS. 6 and 7. Such arrangements enables to disconnect the exercising person from the exerciser without taking off the harness.

Figure 11:
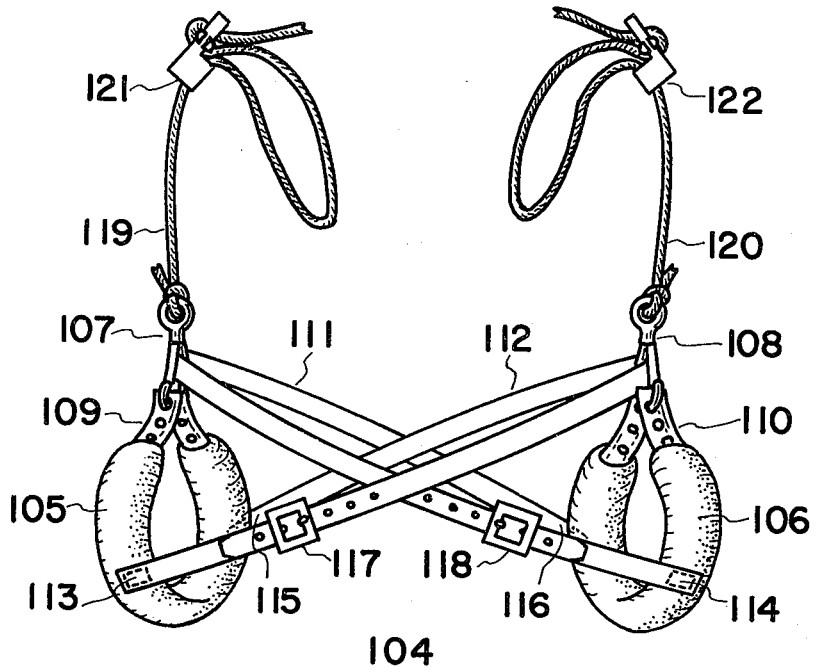
FIG. 11 illustrates a shoulder harness of the present invention usable in conjunction with the variable tension ring exerciser.

In FIG. 11, there is shown a harness 104 including a pair of padded rings 105 and 106 securable around the shoulders of the exercising person. The diameters of these padded rings can be adjusted as snaps 107 and 108 engage various pairs of holes disposed along the straps attached to the ends of padded portion of those rings. The front end 113 and the rear end 115 of strap 112, which strap is threaded through snap 108, are secured to the lower front quarter and lower rear quarter of padded ring 105, respectively. The length of strap 112 can be adjusted and secured by means of buckle 117. The padded ring 106 includes strap 111 similarly secured to that padded ring and threaded through snap 107. The straps 111 and 112 restrain the pair of padded rings from sliping off from the shoulders of the person wearing harness 104. The ropes 119 and 120 secured to snaps 107 and 108, respectively, can be secured to eye bolts 39 and 40 attached to elongated structural member 50, respectively (see FIG. 1), as each rope is threaded through the eye of the appropriate eye bolt and then fastened to the fastener attached to that rope. The fasteners 121 and 122 provide also means of adjusting and securing the lengths of ropes 119 and 120, respectively.

Figure 12:
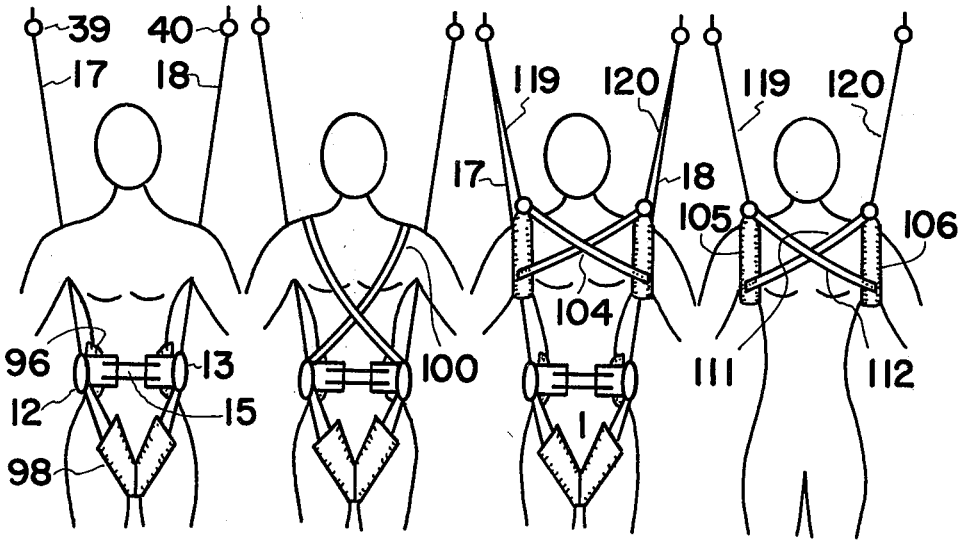
FIG. 12 illustrates a various combinations of wearing harnesses of the present invention.

In FIG. 12, there is shown four exercising persons wearing various combinations of harnesses and accessories. The combined use of bottom harness 1 and top harness 104 is particularly useful for therapeutic application. By adjusting the lengths of ropes 119 and 120 suspending top harness 104 relative to the lengths of ropes 17 and 18 suspending bottom harness 1 (see the second person from right), the force exerted on the backbone of the exercising person can be varied from a tension to a compression. It may be understood that the variable tension ring exerciser is an effective apparatus for training invalids to move their body. When the eye bolts 53 and 54 are connected to a pair of rollers permitted to roll along a pair of elevated rails aligned parallel to one another, respectively, the variable tension ring exerciser becomes an excellent apparatus for training invalids to walk. The harness of the present invention provides the comfort and freedom necessary for such a use of the variable tension ring exerciser.

While the principles of the invention have now been made clear in an illustrative embodiment, there will be immediately obvious to those skilled in the art many modifications of structure, arrangements, proportions, the elements, materials and components used in the practice of the invention which are particularly adapted for specific environments and operating requirements without departing from those principles.

I claim:

1. A hoist usable for lifting and suspending an exercising person in midair in doing aerial exercises, said hoist comprising:

a. a first elongated structural member having a cross section of a channel, said first structural member including:
   1. a first pulley suspended from one extremiety of said first structural member;
   2. a second pulley suspended from the other extremity of said first structural member; and
   3. a plurality of sheaves disposed within the channel of said first structural member in series and rotatably secured to said first structural member; whereby, said sheaves are rotatable about axis normal to the channel walls of said first structural member;

b. a second elongated structural member having a cross section of a channel, said second structural member having a length shorter than the length of said first structural member, said second structural member including;
   1. a plurality of sheaves disposed within the groove of said second structural member in series and rotatably secured to said second structural member; whereby, said sheaves are rotatable about axis normal to the channel walls of said second structural member;
   2. a first means of securing a first rope to one extremity of said second structural member; and
   3. a second means of securing a second rope to the other extremity of said second structural member;

c. a third rope having a first handle attached to one end of said third rope and the other end secured to one of said structural members, said third rope engaging said first pulley and various pairs of said sheaves, each of said pairs of sheaves including a sheave belonging to said first structural member and another sheave belonging to said second structural member; whereby, pull of said first handle moves said pair of structural members toward one another with a force greater than said pull exerted on said first handle; and d. a fourth rope having a second handle attached to one end of said fourth rope and the other end secured to one of said structural members, said fourth rope engaging said second pulley and various pairs of said sheaves, each of said pairs of sheaves including a sheave belonging to said first structural member and another sheave belonging to said second structural member; whereby, pull of said second handle moves said pair of structural members toward one another with a force greater than said pull exerted on said second handle.

2. The combination as set forth in claim 1 wherein said first structural member includes means of securing said hoist to an over hanging structure.

3. The combination as set forth in claim 2 wherein a fifth rope having one end secured to the middle of said first structural member and the other end secured to the middle of said second structural member limits the separation of said pair of structural members to a desired distance.

4. The combination as set forth in claim 3 wherein said sheaves are multiple sheaves.

5. The combination as set forth in claim 3 wherein said sheaves are simple sheaves.

6. The combination as set forth in claim 5 wherein a harness is connected to said hoist, said harness comprising:

a. a belt securable around the lower torso of a exercising person, said belt including;

1. a first means of adjusting and securing the length of the front half of said belt;

2. a second means of adjusting and securing the length of the rear half of said belt;

b. a first ring secured to said belt intermediate said first and second means of adjusting and securing the length of said belt; whereby, said first rope extending from one extremity of said second structural member can be secured to said first ring;

c. a second ring secured to said belt diametrically to said first ring; whereby, said second rope extending from the other extremity of said second structural member can be secured to said second ring;

d. a first Y-shaped strap securable around one thigh of an exercising person, said first Y-shaped strap including;

1. a first branch secured to said belt in the vicinity of said first ring;
2. a second branch secured to said belt intermediate said first ring and said second means of adjusting and securing the belt length; and
3. a third means of securing the free end of said first strap to said belt, said third means of securing disposed in the vicinity of said first ring;

e. a second Y-shaped strap securable around the other thigh of an exercising person, said second Y-shaped strap including;

1. a first branch secured to said belt in the vicinity of said second ring;
2. a second branch secured to said belt intermediate said second ring and said second means of adjusting and securing the belt length; and
3. a fourth means of securing the free end of said second strap to said belt, said fourth means of securing disposed in the vicinity of said second ring.

* * * * *